US008261590B2

(12) United States Patent
Tezuka

(10) Patent No.: US 8,261,590 B2
(45) Date of Patent: Sep. 11, 2012

(54) ROLL POSITION SETTING METHOD OF SENDZIMIR MILL

(75) Inventor: Tomoyuki Tezuka, Tokyo (JP)

(73) Assignee: Toshiba Mitsubishi-Electric Industrial Systems Corporation, Tokyo (JP)

( * ) Notice: Subject to any disclaimer, the term of this patent is extended or adjusted under 35 U.S.C. 154(b) by 274 days.

(21) Appl. No.: 12/739,474

(22) PCT Filed: Nov. 27, 2007

(86) PCT No.: PCT/JP2007/072854
§ 371 (c)(1),
(2), (4) Date: Apr. 23, 2010

(87) PCT Pub. No.: WO2009/069198
PCT Pub. Date: Jun. 4, 2009

(65) Prior Publication Data
US 2011/0308292 A1 Dec. 22, 2011

(51) Int. Cl.
*B21B 13/14* (2006.01)

(52) U.S. Cl. ..... 72/241.2

(58) Field of Classification Search ..... 72/10.4, 72/10.6, 14.4, 14.6, 241.2, 242.4
See application file for complete search history.

(56) References Cited

U.S. PATENT DOCUMENTS 5,692,407 A * 12/1997 Kajiwara et al. ..... 72/241.4

FOREIGN PATENT DOCUMENTS

JP 10-263638 A 10/1998

* cited by examiner

*Primary Examiner* — Faye Francis
(74) *Attorney, Agent, or Firm* — Leydig, Voit & Mayer, Ltd.

(57) ABSTRACT

A roll position setting method for a Sendzimir mill that can easily adapt to combinations of roll sets and enables each roll to be set in a position optimal for operation. Each eccentric angle of first and second backing bearings is set by adjusting a bottom screw device so that an upper surface of the bottom work roll reaches a pass line of the rolled material based on first function. For top side roll setting, the eccentric angle of fourth backing bearings is set by adjusting top side screw devices so that a second function, different from the first function, is optimized.

8 Claims, 5 Drawing Sheets

ROLL POSITION SETTING METHOD OF SENDZIMIR MILL

TECHNICAL FIELD

The present invention relates to a roll position setting method for appropriately setting the roll positions of a Sendzimir mill by use of a plurality of screw down devices.

BACKGROUND ART

When high-hardness materials to be rolled, such as stainless steel, are cold rolled, small diameter work rolls are adopted in a rolling mill. There is a Sendzimir mill as a representative of such rolling mills.

FIG. 1 is a block diagram showing a general Sendzimir mill with 20 rolls. The Sendzimir mill shown in FIG. 1 has a roll arrangement made up of work rolls 2 and 3 in a top and bottom pair, first intermediate rolls 4 to 7 in quantities of two each on top and bottom, second intermediate rolls 8 to 13 in quantities of three each on top and bottom, and backing bearings 14 to 21 in quantities of four each on top and bottom.

Each of the backing bearings 14 to 21 is provided with an eccentricity mechanism, and the position of each of the rolls 2 to 13 is determined by the setting of each eccentric angle of the backing bearings 14 to 21. Each eccentric angle of the backing bearings 14 to 21 is adjusted by a plurality of screw down devices arranged above and below. Concretely, the screw down devices are composed of a top screw down device 22, a bottom screw down device 23, top side screw down devices 24 and 25, and bottom side screw down devices 26 and 27.

On a Sendzimir mill having the above-described arrangement, before the start of rolling, the setting of each of the screw down devices 22 to 27 has hitherto been carried out in the method described below.

That is, each eccentric angle of the backing bearings 18 to 21 is determined so that the bottom work roll 3 maintains pass line, and set by the bottom screw down device 23 and the bottom side screw down devices 26 and 27.

On the other hand, the top screw down device 22 is used to obtain desired thickness. That is, the eccentric angle of the backing bearings 15 and 16 is adjusted by the top screw down device 22 by constant load control so that the rolling load (or pressure) obtains a preset value. Incidentally, after the start of rolling, the eccentric angle of the backing bearings 15 and 16 is appropriately adjusted by gauge control which involves adjusting the gap between the work rolls on the basis of measured thickness values measured by thickness meters.

That is, the top screw down device 22 is not operated on the basis of the preset value of the eccentric angle of the backing bearings 15 and 16, which is not calculated actually. Therefore, it is impossible to know the eccentric angle of the backing bearings 15 and 16 before a screw-down is performed actually. Incidentally, the eccentric angle of the backing bearings 15 and 16 varies also depending on the setting of the eccentric angle of the backing bearings 14 and 17 which is adjusted by the top side screw down devices 24 and 25.

And in a conventional method, the same value was used as the preset values of the four side screw down devices 24 to 27 in consideration of symmetricity. For this reason, the eccentric angle of the backing bearings 14 and 17 was set at the same value as the eccentric angle of the backing bearings 18 and 21 adjusted by the bottom side screw down devices 26 and 27. Due to such circumstances operation has sometimes been carried out with the eccentric angle of the backing bearings 15 and 16 undesirable setting.

Also, as a conventional art, there has been proposed a roll position setting method which involves setting the position of each roll of a Sendzimir mill also in consideration of the eccentric angle of backing bearings by a top screw down device (refer to Patent Document 1, for example).

Concretely, in the roll position setting method described in Patent Document 1, first, the eccentric angle by the top screw down device is determined so that the relation between the cylinder position of the top screw down device and the work roll position be linear. Next, the eccentric angle by the top and bottom side screw down devices are determined to satisfy roll gap, which is given by another calculation, based on the geometric relation of the top side roll set. Lastly, the eccentric angle by the bottom screw down device is determined from a simplified expression on the basis of that by these side screw down devices. And the above-described calculations are repeated until a solution which meets these conditions is obtained.

Patent Document 1: Japanese Patent Laid-Open No. 10-263638

DISCLOSURE OF THE INVENTION

Problems to be Solved by the Invention

In the roll position setting method described in Patent Document 1, problems as described below remain still unsolved.

1. Although the eccentric angle of the backing bearings adjusted by the top screw down device is set in consideration of gauge control, from the standpoint of operation such a setting method is not always optimal.
2. The eccentric angles of the backing bearings adjusted by the top and bottom side screw down devices are all set at the same value and, therefore, combinations of roll sets are remarkably limited.
3. Because of the use of a simplified expression in pass line determination, it is impossible to avoid the error.

The present invention has been made to solve problems as described above and the object of the invention is to provide a roll position setting method of a Sendzimir mill which can easily adapt to combinations of roll sets and enables each roll to be set in a position optimal for operation.

Means for Solving the Problems

A roll position setting method of a Sendzimir mill of the present invention is a roll position setting method of a Sendzimir mill that comprises top and bottom work rolls which roll a rolled material, a plurality of backing bearings having an eccentricity mechanism, a bottom screw down device which adjusts the eccentric angle of first backing bearings arranged in a middle part, which belong to the backing bearings pressing the bottom work roll from below, bottom side screw down devices which adjust the eccentric angle of second backing bearings, which belong to the backing bearings pressing the bottom work roll from below, arranged on the entry side and delivery side of the first backing bearings, a top screw down device which adjusts the eccentric angle of third backing bearings arranged in a middle part, which belong to the backing bearings pressing the top work roll from above, and top side screw down devices which adjust the eccentric angle of fourth backing bearings arranged on the entry side and delivery side of the third backing bearings, which belong to the backing bearings pressing the top work roll from above, which comprises a bottom side setting step of setting each eccentric angle of the first and second backing bearings by adjusting the bottom screw down device and the bottom side screw down devices so that an upper surface of the bottom work roll reaches pass line of the rolled material on the basis of a prescribed first function, and an top side setting step of setting the eccentric angle of the fourth backing bearings by adjusting the top side screw down devices so that a second function different from the first function is optimized.

Effect of the Invention

According to the present invention, it is possible to easily adapt to combinations of roll sets and to set each roll in a position optimal for operation.

BRIEF OF DESCRIPTION OF THE DRAWINGS

DESCRIPTION OF SYMBOLS

1 rolled material,
2 top work roll,
3 bottom work roll,
4-7 first intermediate roll,
8-13 second intermediate roll,
14-21 backing bearing,
22 top screw down device,
23 bottom screw down device,
24-25 top side screw down device,
26-27 bottom side screw down device,
28-29 tension reel,
30-31 thickness meter,
32-33 sensor roll

BEST MODE FOR CARRYING OUT THE INVENTION

The present invention will be described in more detail with reference to the accompanying drawings. Incidentally, in each of the drawings, like numerals refer to like or similar parts and overlaps of description of these parts are appropriately simplified or omitted.

First Embodiment

Figure 1:
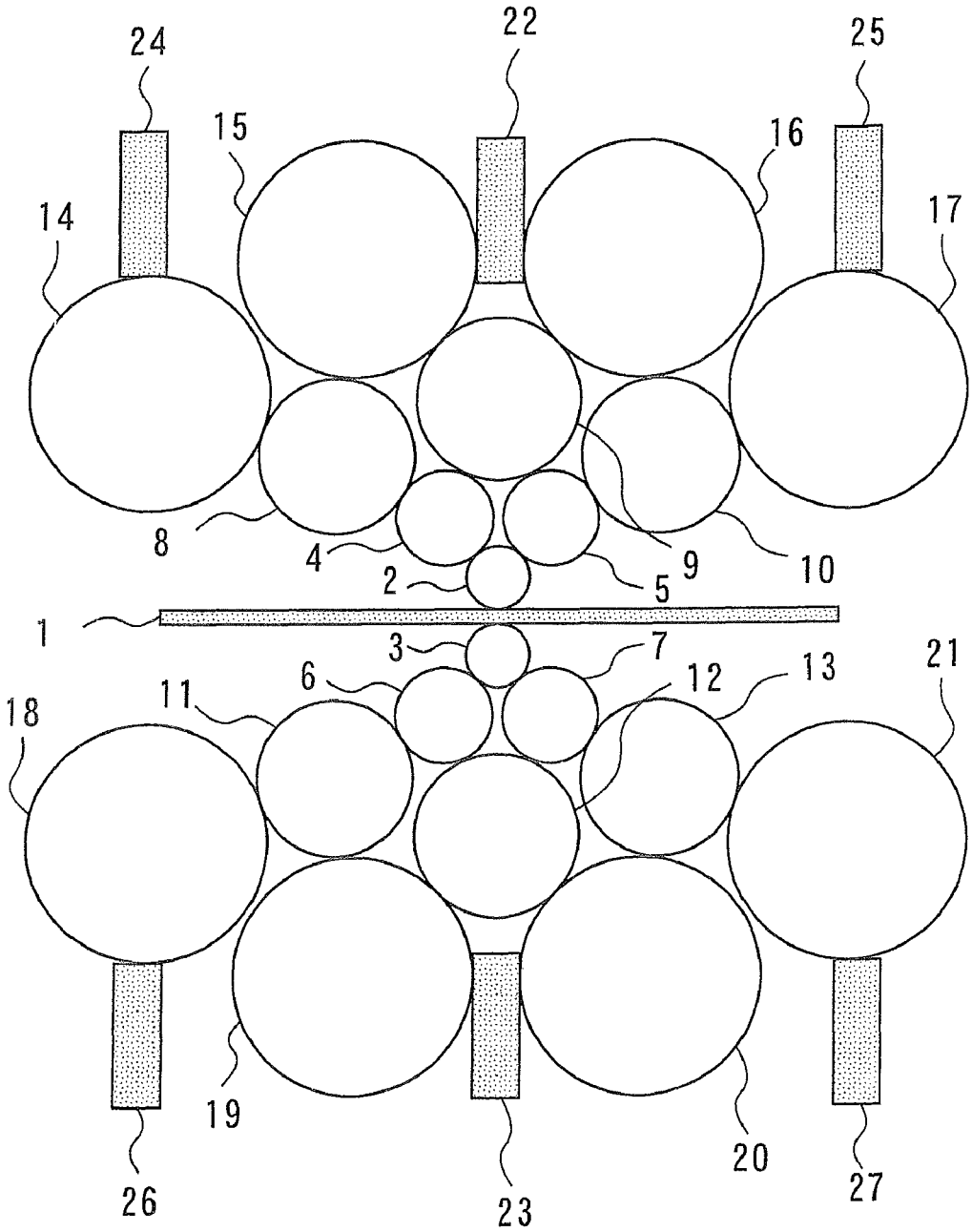
Fig. 1 PRIOR ART
FIG. 1 is a block diagram showing a general Sendzimir mill.

The basic arrangement of the Sendzimir mill in a first embodiment is the same as shown in FIG. 1. As described above, this Sendzimir mill is suitable for rolling a hard material 1, such as stainless steel in cold mill. A concrete arrangement of this Sendzimir mill will be described below.

Reference numerals 2 and 3 denote work rolls in a top and bottom pair, and reference numerals 4 to 7 denote first intermediate rolls, which press the work rolls 2 and 3 toward the rolled material 1, in quantities of two each on top and bottom. The top work roll 2 is pressed downward by the top side first intermediate rolls 4 and 5, and the bottom work roll 3 is pressed upward by the bottom side first intermediate rolls 6 and 7. Reference numerals 8 to 13 denote second intermediate rolls, which press the first intermediate rolls 4 to 7 toward the rolled material 1, in quantities of three each on top and bottom (reference numerals 8, 10, 11 and 13 denote drive rolls and reference numerals 9 and 12 denote idle rolls).

Reference numerals 14 to 21 denote backing bearings, which press the second intermediate rolls 8 to 13 to the rolled material 1, in quantities of four each on top and bottom. The backing bearings 14 to 17 arranged above the rolled material 1 press the top work roll 2 from above via the second intermediate rolls 8 to 10 and the first intermediate rolls 4 and 5. The backing bearings 18 to 21 arranged below the rolled material 1 press the bottom work roll 3 from below via the second intermediate rolls 11 to 13 and the first intermediate rolls 6 and 7. The Sendzimir mill in a first embodiment has a 20-roll arrangement like this.

Each of the backing bearings 14 to 21 is provided with an eccentricity mechanism. And the position of each of the rolls 2 to 13 except the backing bearings 14 to 21 is determined by the setting of the eccentric angle of the backing bearings 14 to 21. The eccentric angle of the backing bearings 14 to 21 is adjusted by a plurality of screw down devices arranged above and below the rolled material 1. Concretely, the screw down devices are broadly divided into four kinds: a top screw down device 22, a bottom screw down device 23, top side screw down devices 24 and 25, and bottom side screw down devices 26 and 27. Incidentally, the illustration of the concrete arrangement of each of the screw down devices 22 to 27 is omitted.

The top screw down device 22 is arranged substantially just above the top work roll 2, and has the function of adjusting the eccentric angle of the backing bearings 15 and 16 (third backing bearings) arranged in a middle part, which belong to the backing bearings 14 to 17. The bottom screw down device 23 is arranged substantially just under the bottom work roll 3, and has the function of adjusting the eccentric angle of backing bearings 19 and 20 (first backing bearings) arranged in a middle part, which belong to the backing bearings 18 to 21.

The top side screw down devices 24 and 25 are each arranged on both sides (the entry side and delivery side or called also the right side and left side) of the top screw down device 22, and have the function of adjusting the eccentric angle of the backing bearings 14 and 17 (fourth backing bearings) arranged on the entry side and delivery side of the backing bearings 15 and 16. Concretely, the eccentric angle of the backing bearing 14 is adjusted by the top side screw down device 24 and the eccentric angle of the backing bearing 17 is adjusted by the top side screw down device 25.

The bottom side screw down devices 26 and 27 are each arranged on both sides (the entry side and delivery side) of the bottom screw down device 23, and have the function of adjusting the eccentric angle of the backing bearings 18 and 21 (second backing bearings) arranged on the entry side and delivery side of the backing bearings 19 and 20. Concretely, the eccentric angle of the backing bearing 18 is adjusted by the bottom side screw down device 26 and the eccentric angle of the backing bearing 21 is adjusted by the bottom side screw down device 27. Incidentally, each of the screw down devices 22 to 27 is configured to be able to adjust (set) the eccentric angle of the respective backing bearings each independently.

Next, a description will be given of a line arrangement having the Sendzimir mill of the above-described arrangement.

Figure 2:
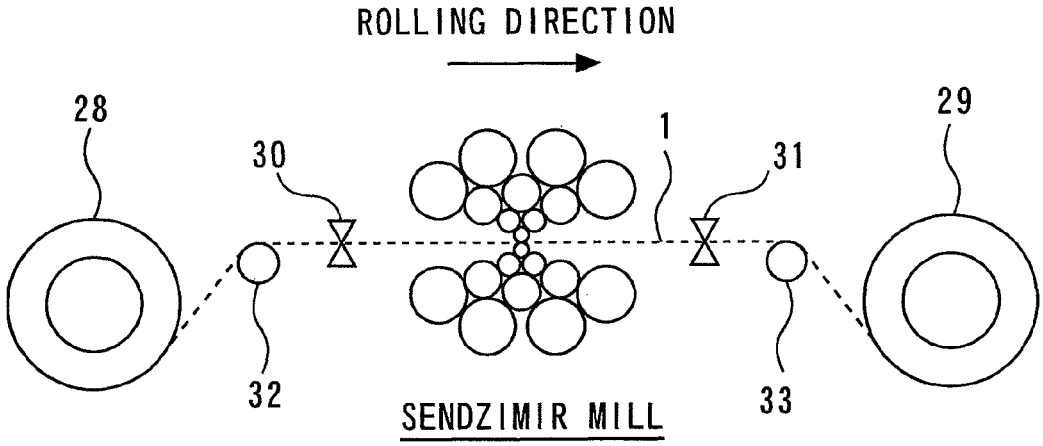
FIG. 2 is a diagram showing a line arrangement including the Sendzimir mill.

FIG. 2 is a diagram showing a line arrangement including the Sendzimir mill. When a difficult-to-be-rolled material 1 such as stainless steel is rolled by being moved from the left side to the right side in FIG. 2, the rolled material (coil) 1 is unwound by left tension reel 28 and the rolled material 1 is delivered to the Sendzimir mill. And after rolling the rolled material 1 on the Sendzimir mill, the rolled material 1 is wound by right tension reel 29. In case of stainless steel rolling, the above-described rolling operation is reciprocally performed and the rolled material 1 is made thin to desired thickness in some passes.

When stainless steel is rolled, in general, rolling is reciprocally repeated, with part of the rolled material 1 kept constantly wound on both tension reels 28 and 29. Furthermore, though not shown in FIG. 2, usually, on the outside of the tension reel 28 or 29 there is provided a pay off reel which pays off the rolled material 1.

Incidentally, reference numerals 30 and 31 in FIG. 2 denote thickness meters installed on the entry side and delivery side of the Sendzimir mill. After the start of rolling, various kinds of gauge control functions work on the basis of measurement results of the thickness meters 30 and 31 so that desired thickness is obtained. Also, shape control is performed on the basis of measurement results of a sensor roll installed on the delivery side (a sensor roll 33 in the case of the rolling direction shown in FIG. 2, a sensor roll 32 in the case of a leftward rolling direction).

In the Sendzimir mill having the above-described arrangement, as a matter of course, before the start of rolling it is necessary to set roll positions by determining the eccentric angle of each of the backing bearings 14 to 21 by use of each of the screw down devices 22 to 27. A concrete setting method of roll positions will be described below.

For a roll set arranged below the rolled material 1 (hereinafter referred to as "the bottom side roll set"), it is important to keep the pass line. That is, each eccentric angle of the backing bearings 18 to 21 is adjusted by the bottom screw down device 23 and the bottom side screw down devices 26 and 27, whereby setting is performed on the basis of a prescribed function (a first function) so that an upper surface of the bottom work roll 3 reaches the pass line.

Figure 3:
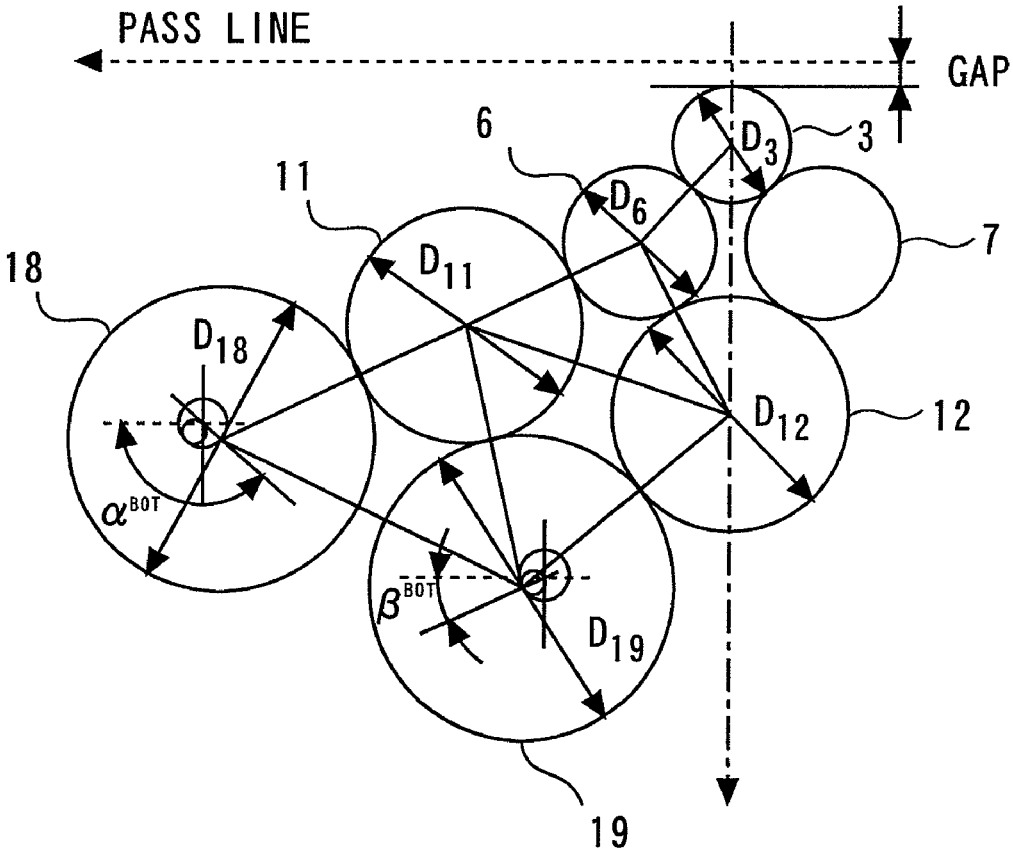
FIG. 3 is a diagram to explain a roll position setting method of the bottom side roll set.

FIG. 3 is a diagram to explain a roll position setting method of the bottom side roll set. A description will be given of a concrete roll position setting method related to the bottom side roll set on the basis of FIG. 3. In FIG. 3, $\alpha^{BOT}$ denotes the eccentric angle of the backing bearing 18 capable of being adjusted by the bottom side screw down device 26, $\beta^{BOT}$ denotes the eccentric angle of the backing bearing 19 capable of being adjusted by the bottom screw down device 23, and D denotes roll diameter (the suffix of D indicates roll number. For example, $D_3$ indicates the diameter of the work roll 3, and $D_{19}$ indicates the diameter of the backing bearing 19). Incidentally, FIG. 3 shows only details of the left side half because the bottom side roll set is laterally symmetrical.

Keeping the pass line for the bottom side roll set means that in FIG. 3, a gap formed between the pass line and the upper surface of the bottom work roll 3 is set at 0. As shown in FIG. 3, because the diameter of each roll and the relation of the rolls in contact are known, it is possible to geometrically calculate this gap itself from each eccentric angle of the backing bearings 18 to 21 (i.e., each set value of the bottom screw down device 23 and the bottom side screw down devices 26 and 27).

However, it is very difficult to find the eccentric angle of the backing bearings 18 to 21 by the back calculation of the above-described calculation formula at the gap calculation. Therefore, in actual rolling, before the start of rolling, each eccentric angle of the backing bearings 18 to 21 is found by the following method and the bottom screw down device 23 and the bottom side screw down devices 26 and 27 are appropriately set.

That is, before the start of rolling, first, each eccentric angle of the backing bearings 18 to 21 is changed in the range in which setting by the bottom screw down device 23 and the bottom side screw down devices 26 and 27 is possible, and a gap generated at that time is calculated. And each eccentric angle of the backing bearings 18 to 21 is found out by the above-described calculation so that the gap becomes within a prescribed range, for example, as given by $$-0.1<\text{Gap}<0.1\ [\text{mm}] \quad (1)$$

Incidentally, in general, the roll sets of a Sendzimir mill are arranged laterally symmetrical, and therefore the above-described calculation is carried out by using the roll diameter shown below left in FIG. 3, for example. By using the above-described method, before the start of rolling, it is possible to appropriately set the bottom screw down device 23 and the bottom side screw down devices 26 and 27 so that the upper surface of the bottom work roll 3 reaches the pass line.

Next, a concrete description will be given of a roll position setting method of a roll set arranged above the rolled material 1 (hereinafter referred to as "the top side roll set").

For the backing bearings 15 and 16, the eccentric angle thereof is set by the adjustment of the top screw down device 22 so that the rolling load P to the rolled material 1 becomes a preset value. For the backing bearings 14 and 17, the eccentric angle thereof is set by the adjustment of the top side screw down devices 24 and 25 so that a prescribed second function different from the above-described first function becomes optimum.

Incidentally, for the top side roll set, concretely the following two kinds of setting methods are conceivable.

Setting method A: The above-described second function is expressed by the ratio of a force received by the top work roll 2 from the rolled material 1 to a force applied to the top screw down device 22 (a force given by the top screw down device 22 to the backing bearings 15 and 16), and the eccentric angle of the backing bearings 14 and 17 is set so that this second function becomes maximal.

Setting method B: The above-described second function is composed of a cost function which has the eccentric angle of the backing bearings 15 and 16 and the eccentric angle of the backing bearings 14 and 17 as variables, and the eccentric angle of the backing bearings 14 and 17 is set so that this second function becomes minimal.

First, the above-described setting method A will be described on the basis of FIG. 4.

Figure 4:
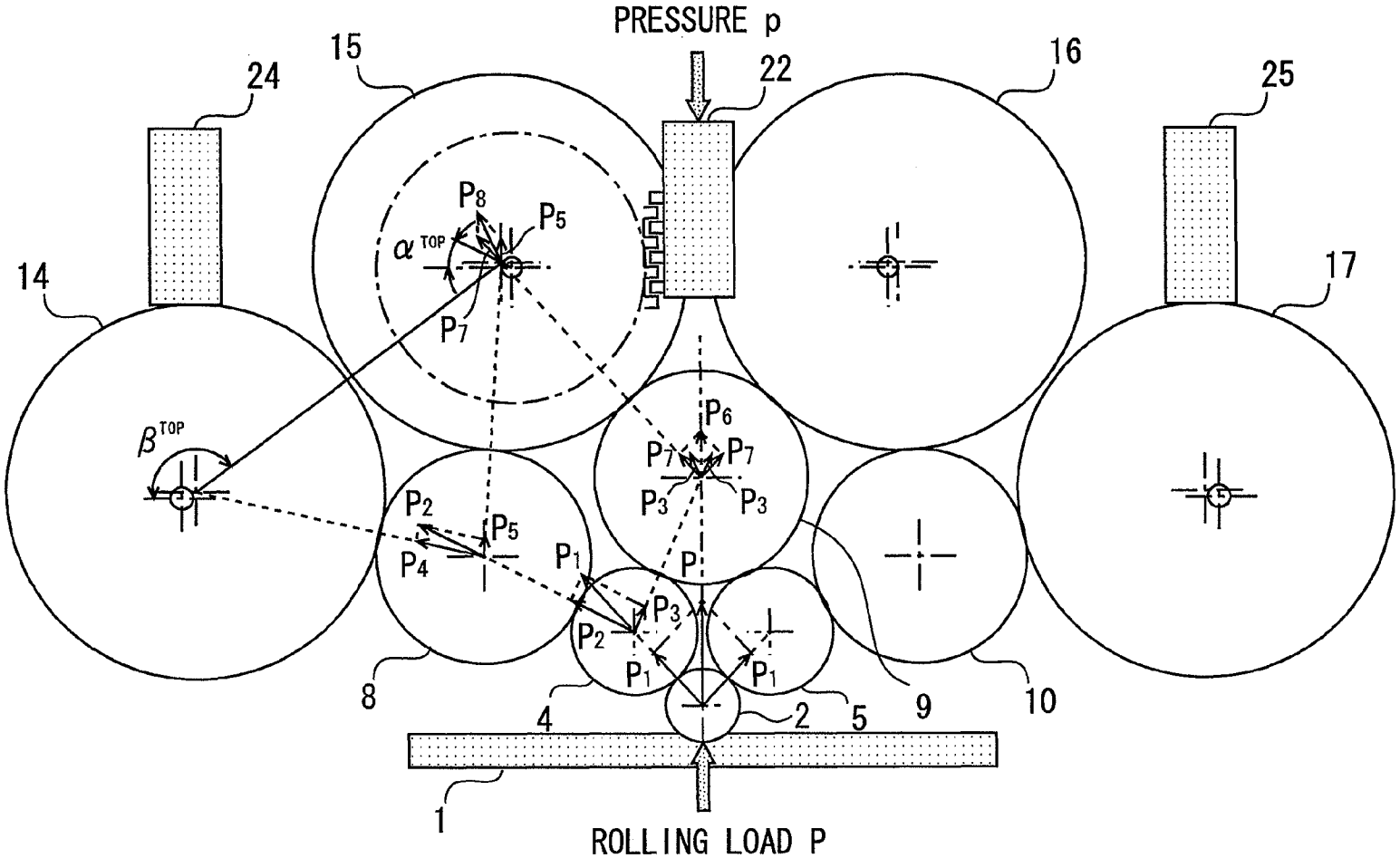
FIG. 4 is a diagram to explain an example of a roll position setting method of the top side roll set.

FIG. 4 is a diagram to explain an example of a roll position setting method of the top side roll set. Incidentally, p in FIG. 4 denotes a pressure applied to the top screw down device 22, and P denotes a rolling load received by the rolled material 1 (an upward force received by the top work roll 2 from the rolled material 1). $P_1$ to $P_8$ denote the transmission relations of forces to each roll.

Concretely, $P_1$ is a component force generated by dividing the rolling load P in the direction of a straight line connecting the center of the roll 2 and the center of the roll 4, $P_2$ is a component force generated by dividing the component force $P_1$ in the direction of a straight line connecting the center of the roll 4 and the center of the roll 8, and $P_3$ is a component force generated by dividing the component force $P_1$ in the direction of a straight line connecting the center of the roll 4 and the center of the roll 9. Similarly, $P_4$ and $P_5$ are each a component force generated by dividing the component force $P_2$, $P_6$ is a resultant force of the $P_3$ received from the roll 4 and of the component force $P_3$ received from the roll 5, $P_7$ is a component force generated by dividing the resultant force $P_6$ in the direction of a straight line connecting the center of the roll 9 and the center of the roll 15, and $P_8$ is a resultant force of the component force $P_5$ and the component force $P_7$. Incidentally, because the top side roll set is laterally symmetrical, the foregoing provides a detailed description of only the left side half.

Ratio of above-described pressure p to rolling load P $$\text{Ratio}=(\text{Rolling load } P)/(\text{pressure } p) \quad (2)$$

can be geometrically calculated from each eccentric angle of the backing bearings 14 to 17 (i.e., each set value of the top screw down device 22 and the top side screw down devices 24 and 25), because the diameter of each roll and the relation of the rolls in contact are known. Therefore, each eccentric angle of the backing bearings 14 to 17 is sequentially changed in a rage in which setting by top screw down device 22 and the top side screw down devices 24 and 25 is possible, and a combination in which the ratio expressed by Expression (2) above becomes maximal can be selected in this change.

However, the top screw down device 22 sets the eccentric angle of the backing bearings 15 and 16 so that the rolling load P (or the pressure p) becomes the preset value. For this reason, the eccentric angle of the backing bearings 15 and 16 does not always coincide with the eccentric angle found so that the ratio expressed by Expression (2) above becomes maximal. That is, this means that the ratio calculated by Expression (2) above does not always become maximal in a roll position in the case where roll gap closes until rolling load P reaches the preset value.

Hence, the eccentric angle of the backing bearings 15 and 16 in roll gap close condition (a set value of the top screw down device 22) is estimated and if Expression (2) above is evaluated by using this estimated eccentric angle, then it is possible to constantly make the ratio maximal in roll gap close condition.

Hereinafter, with the aid of the flow of FIG. 5 a description will be given of a method of finding the above-described ratio by estimating the eccentric angle of the backing bearings 15 and 16 in roll gap close condition.

Figure 5:
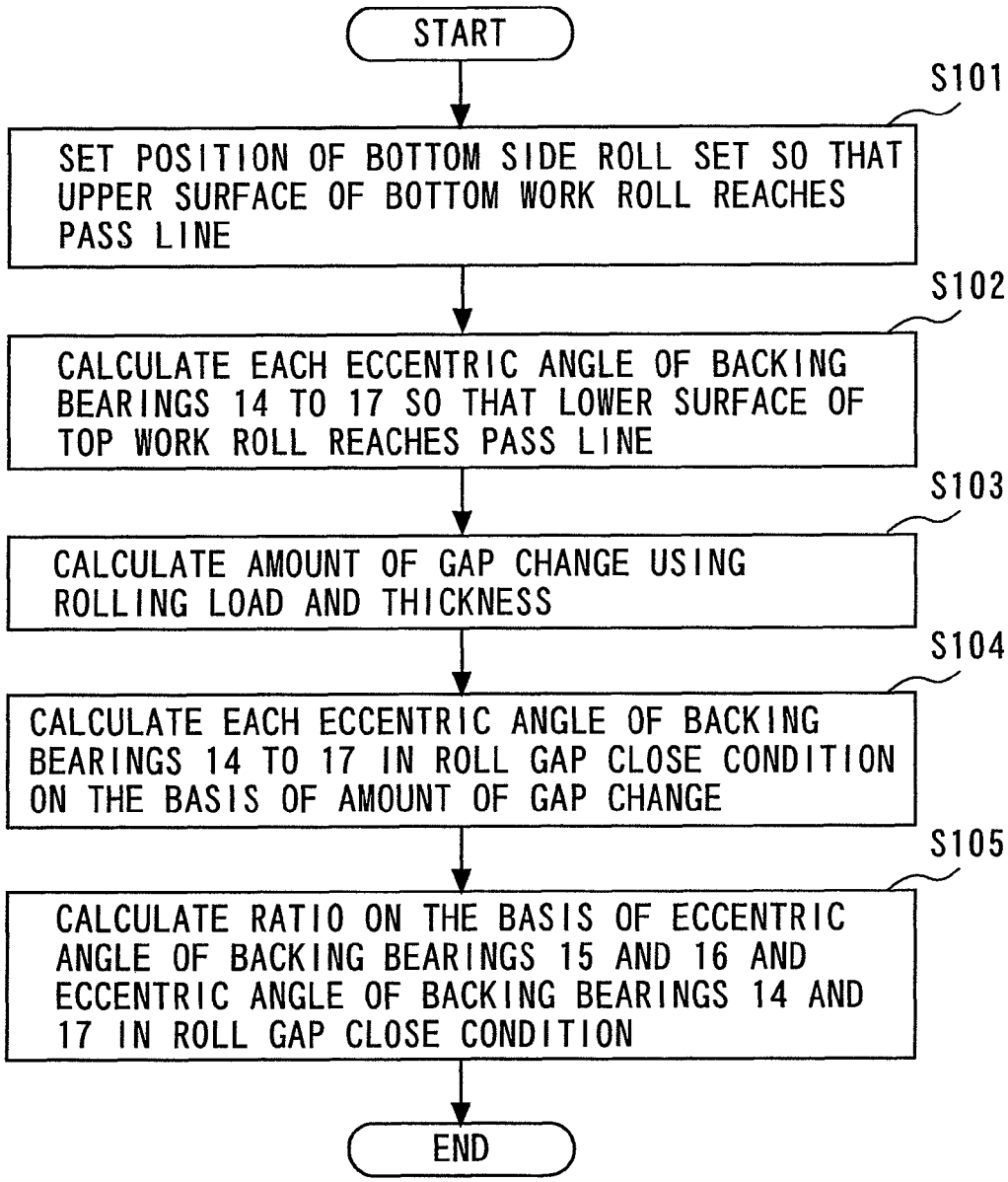
FIG. 5 is a flowchart showing an example of a roll position setting method of the top side roll set.

FIG. 5 is a flowchart showing an example of a roll position setting method of the top side roll set. After the roll position setting of the bottom side roll set as described above (S101), first, each eccentric angle of the backing bearings 14 to 17 is found so that the lower surface of the top work roll 2 reaches the pass line (S102). This calculation at S102 can be performed in the same manner as the case where each eccentric angle of the backing bearings 18 to 21 is calculated at S101.

Incidentally, at S102 above, as described above, each eccentric angle of the backing bearings 14 to 17 may be found under the condition that the lower surface of the top work roll 2 is caused to reach the pass line, or each eccentric angle may also be found by using some other condition by changing this condition.

The value obtained at S102 is a value obtained when the rolled material 1 does not exist, and during actual rolling, the rolled material 1 having prescribed thickness is present between the top and bottom work rolls 2 and 3. As described above, during actual rolling, each eccentric angle of the backing bearings 15 and 16 is set by the top screw down device 22 so that the rolling load P (or the pressure p) becomes a preset value. That is, the lower surface of the top work roll 2 in roll gap close condition is pushed back from the pass line by just thickness of the rolled material 1 and furthermore moves downward to a position so as to cancel out the amount of mill stretch occurring due to the rolling load (or the pressure).

From the foregoing, the position of the lower surface of the top work roll 2 becomes a position where the lower surface opens (moves upward) by just the amount of gap change given by the following expression from the pass line (S103):

$$\Delta S=f\hat{s}(h,P) \quad (3)$$

where, h is the delivery thickness.

Incidentally, because the Sendzimir mill shown in FIGS. 1 to 4 has a 20-roll arrangement, the hysteresis is very large and the calculation of the above-described amount of gap change ΔS may sometimes be difficult. In such a case, it becomes possible to obtain stable calculation results if a prescribed offset amount from the pass line is preset on the basis of empirical values and this offset amount is used instead of the above-described amount of gap change. Also, if a table which is stratified by steel grades and the like is prepared beforehand, it is possible to cope with various situations and it becomes possible to easily perform maintenance.

Next, the eccentric angle of the backing bearings 15 and 16 in roll gap close condition is found on the basis of the amount of gap change ΔS obtained at S103. At this time, with the eccentric angle of the backing bearings 14 and 17 (i.e., a set value of the top side screw down devices 24 and 25) kept fixed, the gap is compensated for by the eccentric angle of the backing bearings 15 and 16 (i.e., the top screw down device 22). This calculation is basically the same as the calculation for pass line setting. That is, each eccentric angle of the relevant backing bearings 14 to 17 is found by using the following expression as a conditional expression in place of Expression (1) while changing only the eccentric angle of the backing bearings 15 and 16 (S104):

$$\Delta S-0.1<\text{Gap}<\Delta S+0.1 \text{ [mm]} \quad (4)$$

Lastly, the ratio of Expression (2) is calculated on the basis of combinations of each eccentric angle obtained by the calculation at S104 (S105). Such calculations are carried out in a range in which the setting of each eccentric angle of the backing bearings 14 to 17 is possible, and a value at which the ratio becomes maximal is set as the eccentric angle of the backing bearings 14 and 17. The top side screw down devices 24 and 25 are set like this, whereby the above-described ratio becomes maximal in roll gap close condition when the top screw down device 22 is set on the basis of the rolling load (or the pressure).

By setting roll positions by the above-described method A, rolling is done in the minimum energy and it is efficient. By setting the ratio given by Expression (2) at a maximum, it is possible to take a large draft per pass and as a result of this, it also improves production efficiency by reducing the number of passes. Furthermore, according to the above-described method, because the top side screw down devices 24 and 25 and the bottom side screw down devices 26 and 27 are differently set, this offers the advantages that setting limitations related to combinations of roll sets become lax and that roll management becomes easy.

Next, the above setting method B will be described.

As described above, in the setting method A, each eccentric angle was set so that the ratio given by Expression (2) becomes maximal. In contrast to this method, in the setting method B, the purpose is to perform setting so that the eccentric angle of the backing bearings 15 and 16 set by the top screw down device 22 and the eccentric angle of the backing bearings 14 and 17 each become a desired value.

That is, in the setting method B, instead of making the ratio given by Expression (2) above maximal, the following cost function is considered:

$$J=f_j(\alpha^{TOP}-\alpha^{TOP-AIM},\beta^{TOP}-\beta^{TOP-AIM})$$

Eccentric angles ($\alpha^{TOP}$, $\beta^{TOP}$) which minimize this cost function J are used as set values. In this expression, variables have the following meanings:

$\alpha^{TOP}$: Eccentric angle of the backing bearings 14 and 17 [deg]

$\alpha^{TOP_AIM}$: Target value of eccentric angle of the backing bearings 14 and 17 [deg]

$\beta^{TOP}$: Eccentric angle of the backing bearings 15 and 16[deg]

$\beta^{TOP_AIM}$: Target value of eccentric angle of the backing bearings 15 and 16 [deg]

Incidentally, also in this setting method B, it is possible to perform evaluation by using eccentric angles in roll gap close condition as with the setting method A.

Because the setting methods A and B differ from each other in the cost functions alone and are the same in other calculation, the detail explanation is omitted for the setting method B. As a result of this, it is possible to set the eccentric angle of the top side backing bearings 14 to 17 at a desired value.

For the reason that damage in case of strip breakage can be reduced by providing gap in the opening direction of screw-down and that too much closing is not preferable as the initial position in the point of view of rolling the rolled material in multiple passes continuously, it is often desired that the eccentric angle of the backing bearings 15 and 16 be set around the center position in the allowable range. The setting method B is intended for use in such a case and contributes to stable operation.

In the calculation of the eccentric angle of the top side backing bearings, because in general the arrangement is laterally symmetrical as with the bottom side backing bearings, the calculation is performed by using the top left roll diameter, for example.

Incidentally, for the setting of each eccentric angle of the backing bearings, it is apparent that the same effect can be achieved as the present invention even when the top side backing bearings and the bottom side backing bearings are applied to a relation reverse to the above-described relation. Furthermore, in actual rolling, an offset may sometimes be considered to the pass line setting due to operational reasons. The present invention can be easily applied also to such a case.

INDUSTRIAL APPLICABILITY

Although in the above-described embodiment the description shows the application to Sendzimir mill, the present invention is not limited by this, and it is possible to apply the present invention to rolling mills having similar functions, for example, cluster mill.

The invention claimed is:

1. A roll position setting method for setting rolls of a Sendzimir mill that includes top and bottom work rolls which roll a rolled material, a plurality of backing bearings having an eccentricity mechanism, a bottom screw device which adjusts eccentric angle of first backing bearings, of the backing bearings, arranged in a middle part, and which press the bottom work roll from below, bottom side screw devices which adjust eccentric angle of second backing bearings, of the backing bearings, and which press the bottom work roll from below, located on an entry side and a delivery side of the first backing bearings, a top screw device which adjusts eccentric angle of third backing bearings, of the backing bearings, located in a middle part, and which press the top work roll from above, and top side screw devices which adjust eccentric angle of fourth backing bearings, of the backing bearings, located on an entry side and a delivery side of the third backing bearings, which press the top work roll from above, the method comprising:

setting the eccentric angles of the first and second backing bearings by adjusting the bottom screw device and the bottom side screw devices so that an upper surface of the bottom work roll reaches a pass line of the rolled material; and setting the eccentric angle of the fourth backing bearings by adjusting the top side screw devices so that a ratio of a force received by the rolled material from the top work roll to a force applied by the top screw device to the third backing bearings is maximized.

2. The roll position setting method according to claim 1, including calculating the eccentric angle of the third backing bearings in a roll gap close condition.

3. The roll position setting method according to claim 2, including calculating the eccentric angle of the third backing bearings in the roll gap close condition using a rolling load applied to the rolled material and thickness of the rolled material.

4. The roll position setting method according to claim 2, including calculating the eccentric angle of the third backing bearings in the roll gap close condition using a prescribed offset from the pass line.

5. A roll position setting method for setting rolls of a Sendzimir mill that includes top and bottom work rolls which roll a rolled material, a plurality of backing bearings having an eccentricity mechanism, a bottom screw device which adjusts eccentric angle of first backing bearings, of the backing bearings, arranged in a middle part, and which press the bottom work roll from below, bottom side screw devices which adjust eccentric angle of second backing bearings, of the backing bearings, and which press the bottom work roll from below, located on an entry side and a delivery side of the first backing bearings, a top screw device which adjusts eccentric angle of third backing bearings, of the backing bearings, located in a middle part, and which press the top work roll from above, and top side screw devices which adjust eccentric angle of fourth backing bearings, of the backing bearings, located on an entry side and a delivery side of the third backing bearings, which press the top work roll from above, the method comprising:

setting the eccentric angles of the first and second backing bearings by adjusting the bottom screw device and the bottom side screw devices so that an upper surface of the bottom work roll reaches a pass line of the rolled material; and setting the eccentric angle of the fourth backing bearings by adjusting the top side screw devices so that a cost function, which has the eccentric angle of the third backing bearings and the eccentric angle of the fourth backing bearings as variables, is minimized.

6. The roll position setting method according to claim 5, wherein the cost function includes, in part, the eccentric angle of the third backing bearings in a roll gap close condition.

7. The roll position setting method according to claim 6, including calculating the eccentric angle of the third backing bearings in the roll gap close condition using a rolling load applied to the rolled material and thickness of the rolled material.

8. The roll position setting method according to claim 6, including calculating the eccentric angle of the third backing bearings in the roll gap close condition using a prescribed offset from the pass line.

* * * * *